US009554628B2

(12) United States Patent
Chapek

(10) Patent No.: US 9,554,628 B2
(45) Date of Patent: Jan. 31, 2017

(54) CHILD RESISTANT SLIDER HAVING INSERTABLE TORPEDO AND METHODS

(71) Applicant: Reynolds Presto Products Inc., Lake Forest, IL (US)

(72) Inventor: Carlos Chapek, Victor, NY (US)

(73) Assignee: Reynolds Presto Products Inc., Lake Forest, IL (US)

( * ) Notice: Subject to any disclaimer, the term of this patent is extended or adjusted under 35 U.S.C. 154(b) by 0 days.

(21) Appl. No.: 15/225,502

(22) Filed: Aug. 1, 2016

(65) Prior Publication Data

US 2016/0338454 A1 Nov. 24, 2016

Related U.S. Application Data

(63) Continuation of application No. 14/247,835, filed on Apr. 8, 2014, now Pat. No. 9,505,531.

(60) Provisional application No. 61/810,078, filed on Apr. 9, 2013.

(51) Int. Cl.

| | |
|---|---|
| ***A44B 19/26*** | (2006.01) |
| ***A44B 19/30*** | (2006.01) |
| ***A44B 19/16*** | (2006.01) |
| ***B65D 33/25*** | (2006.01) |
| ***B65D 50/00*** | (2006.01) |

(52) U.S. Cl.

CPC ..... *A44B 19/303* (2013.01); *A44B 19/16* (2013.01); *B65D 33/2591* (2013.01); *B65D 50/00* (2013.01); *B65D 2215/00* (2013.01)

(58) Field of Classification Search

CPC ..... A44B 19/26; A44B 19/267; A44B 19/16; A44B 19/303; B65D 33/2508; B65D 33/2541;B65D 33/255; B65D 33/2591; B65D 2215/04; Y10T 24/2534; Y10T 24/2561; Y10T 24/2564

USPC ..... 24/417

See application file for complete search history.

(56) References Cited

U.S. PATENT DOCUMENTS

| | | | |
|---|---|---|---|
| 5,007,143 | A | 4/1991 | Herrington |
| 5,088,971 | A | 2/1992 | Herrington |
| 5,131,121 | A | 7/1992 | Herrington, Jr. et al. |
| 5,161,286 | A | 11/1992 | Herrington, Jr. et al. |
| 5,448,807 | A | 9/1995 | Herrington, Jr. |
| 5,681,115 | A | 10/1997 | Diederich et al. |
| 5,711,609 | A | 1/1998 | Simonsen |
| 5,775,812 | A | 7/1998 | St. Phillips et al. |
| 6,036,364 | A | 3/2000 | Heuvel |
| 6,287,000 | B1 | 9/2001 | Buchman |

(Continued)

FOREIGN PATENT DOCUMENTS

| | | |
|---|---|---|
| EP | 1 312 278 A1 | 5/2003 |
| EP | 1 391 390 A1 | 2/2004 |

(Continued)

OTHER PUBLICATIONS

International Search Report and Written Opinion for PCT/US2014/032929 mailed Jul. 3, 2014.

*Primary Examiner* — Jack W Lavinder
(74) *Attorney, Agent, or Firm* — Merchant & Gould P.C.

(57) ABSTRACT

A child resistant zipper closure for a bag includes a slider having a flexible tab with a torpedo. To open a zipper closure, the tab must be held in a downward position to engage the torpedo between male and female tracks and result in separation of interlocked complementary profiles, while the slider is moved along the zipper closure.

19 Claims, 4 Drawing Sheets

(56) References Cited

U.S. PATENT DOCUMENTS

| | | | | |
|---|---|---|---|---|
| 6,361,213 | B2 | 3/2002 | Randall | |
| 6,376,035 | B1 | 4/2002 | Dobreski et al. | |
| 6,789,947 | B1 * | 9/2004 | Kasai | B65D 33/2591 24/400 |
| 6,846,108 | B2 | 1/2005 | Buchman | |
| 7,255,477 | B2 | 8/2007 | Arnell | |
| 7,416,340 | B2 | 8/2008 | Schneider | |
| 7,524,110 | B2 | 4/2009 | Anzini et al. | |
| 7,543,362 | B2 | 6/2009 | Olechowski | |
| 7,670,052 | B2 | 3/2010 | Chaturvedi | |
| 7,921,534 | B2 | 4/2011 | Patel et al. | |
| 7,946,003 | B2 | 5/2011 | Sprague et al. | |
| 2002/0064320 | A1 | 5/2002 | May | |
| 2003/0000050 | A1 | 1/2003 | Blythe | |
| 2003/0014848 | A1 | 1/2003 | LaRue et al. | |
| 2003/0138171 | A1 | 7/2003 | Kikuchi | |
| 2004/0083782 | A1 | 5/2004 | Lantz | |
| 2005/0257351 | A1 | 11/2005 | Pitts et al. | |
| 2006/0008186 | A1 | 1/2006 | Kusz | |
| 2006/0133700 | A1 | 6/2006 | Cappel | |
| 2006/0168779 | A1 | 8/2006 | Chaturvedi | |
| 2007/0071367 | A1 | 3/2007 | Buchman | |
| 2009/0139067 | A1 | 6/2009 | Ackerman | |
| 2010/0011545 | A1 | 1/2010 | Anzini | |

FOREIGN PATENT DOCUMENTS

| | | | |
|---|---|---|---|
| EP | 1 661 479 | B1 | 6/2010 |
| FR | 2 770 493 | A1 | 5/1999 |
| WO | WO 2009/112078 | A1 | 9/2009 |
| WO | WO 2010/008917 | A1 | 1/2010 |
| WO | WO 2010/029455 | A1 | 3/2010 |

* cited by examiner

CHILD RESISTANT SLIDER HAVING INSERTABLE TORPEDO AND METHODS

CROSS REFERENCE TO RELATED APPLICATION

This application is a Continuation of U.S. Ser. No. 14/247,835, filed Apr. 8, 2014, which claims the benefit of provisional application Ser. No. 61/810,078, filed Apr. 9, 2013, which is incorporated herein by reference in its entirety.

TECHNICAL FIELD

This disclosure relates to a reclosable zipper pouch. More particularly, this disclosure relates to a reclosable zipper pouch that is child resistant.

BACKGROUND

Manufacturers of household products have increasingly replaced rigid packages with reclosable flexible packages due to the advantages offered by these flexible packages that include: less packaging material, lower package cost, reduced storage space, and lower shipping costs.

Once reclosable flexible packages containing household products are purchased, they are typically stored in a convenient household location where they are retrieved, opened, and reclosed until the contents are depleted. Opening and reclosing of these packages is easy for both adults and children. If these packages contain potentially harmful products and are accessible to young children, this presents a risk to them. As a result, there is a need to provide for a large scale closure and method to increase the difficulty for children to open the pouch and yet provide adequate means for adults and senior citizens to open the pouch.

SUMMARY

In one aspect, a child resistant slider zipper closure system is provided. The system includes a reclosable zipper closure with a male track and a female track having complementary profiles for interlocking and unlocking. A notch is defined by the complementary profiles, the notch being spaced from an end of the slider zipper closure system. A slider is slidably located on the zipper closure. The slider includes a flexible tab with a torpedo. When the slider is moved into a vicinity of the notch, the tab is selectively moveable into a position to be between the male track and female track and result in separation of the interlocking profiles and open the mouth as the slider is moved in an opening direction along the zipper closure.

In another aspect, a slider for a zipper closure having a male track and female track with complementary interlocking profiles is provided. The slider includes a base having a top member and a bottom member. The bottom member includes first and second legs. The base is adapted to move along top edges of the tracks with the first and second legs straddling the tracks. A tab extends from the top member of the base and is spaced above the first and second legs of the base. The tab is constructed and arranged to flex relative to the base about a pivot axis in a direction toward and away from the first and second legs. A torpedo extends from a bottom surface of the tab and flexes toward and away from the first and second legs with the flexing of the tab. The torpedo is selectively movable into a position between the male track and female track and result in separation of the interlocking profiles as the slider is moved in an opening direction along the zipper closure. The first and second legs have internal surfaces spaced sufficiently close together to press the profiles into interlocking relationship as the slider is moved in a closing direction along the zipper closure.

In another aspect, a method of operating a zippered bag having an openable and reclosable mouth is provided. The method includes providing a zippered bag having first and second panels each having a top forming the mouth, a bottom, and first and second opposing sides. The first and second panels are joined to each other along their respective bottoms, their respective first opposing sides, and their respective second opposing sides. A zipper closure including a male track female track having complementary interlocking and unlocking profiles is provided. One of the profiles is in proximity to the top of the first panel, while the other profile is in proximity to the top of the second panel. The profiles interlock to close the mouth and unlock to open the mouth. The zipper closure includes a notch spaced from the first side. A slider is located on the zipper closure. The method includes opening the mouth by moving the slider to the notch; pressing down on a flexible tab on the slider to position a torpedo under the tab between the male track and female track; and while pressing, moving the slider in an opening direction along the zipper closure to result in separation of the interlocking profiles.

A variety of examples of desirable product features or methods are set forth in part in the description that follows, and in part will be apparent from the description, or may be learned by practicing various aspects of this disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Figure 13:
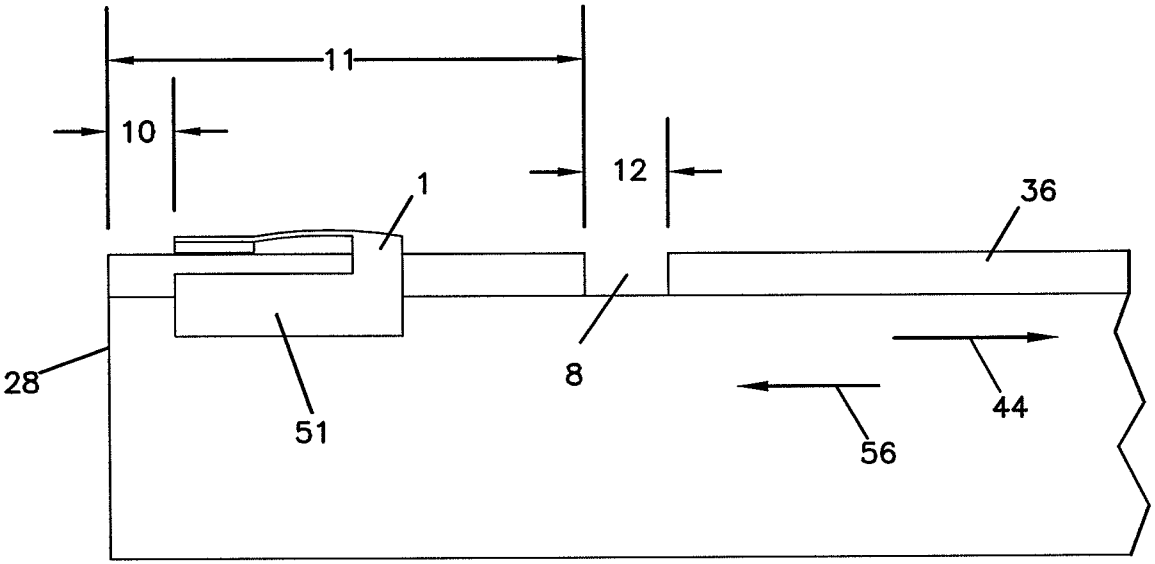
FIG. 13 is a schematic section of a reclosable zipper closure with the slider of FIGS. 1 and 2 assembled thereon.

In reference first to FIG. 13, a portion of a bag B is shown having a reclosable zipper closure 36. The zipper closure 36 includes child resistant opening features to inhibit a child from easily being able to open the zipper closure 36.

In particular, zipper closure 36 includes slider 1 with child resistant features. More details on the slider 1 are discussed further below.

Figure 15:
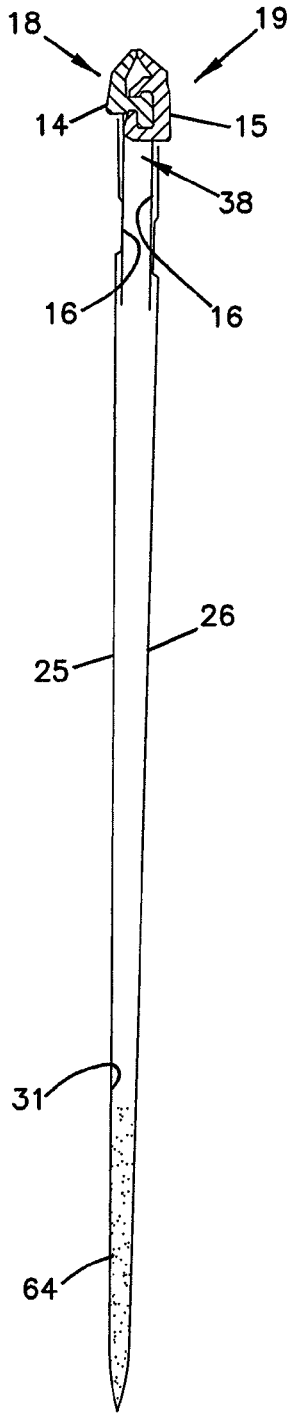
FIG. 15 is a cross-sectional view of the bag of FIG. 14.
Figure 14:
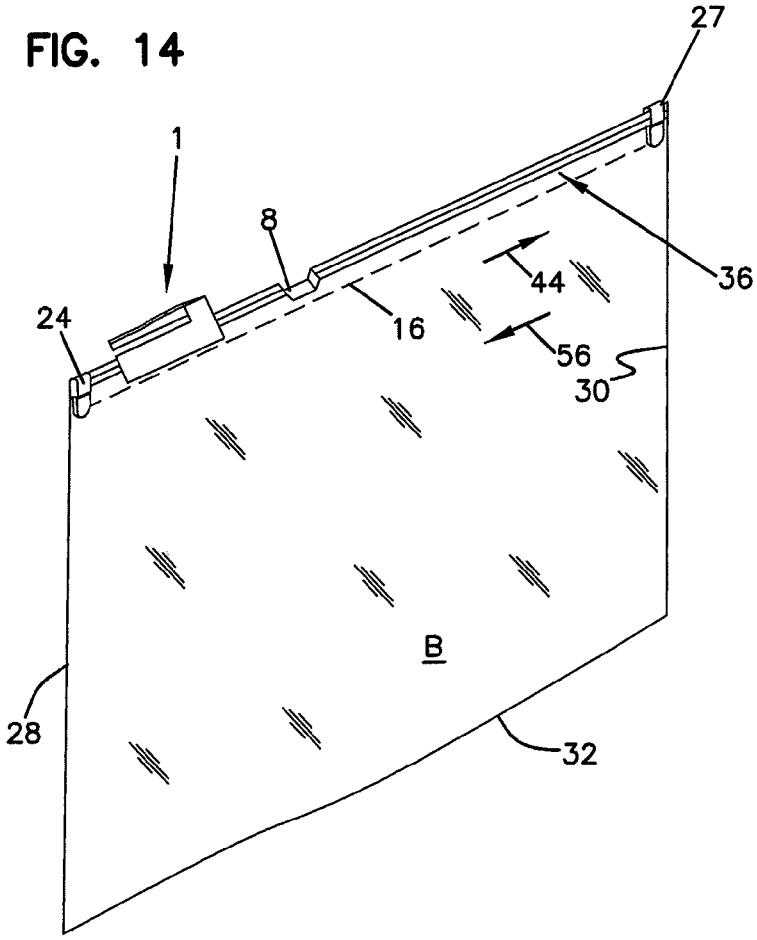
FIG. 14 is a schematic perspective view of an example embodiment of a bag with the reclosable zipper closure and slider of FIG. 13.

In the example embodiment, the bag B (as shown in FIGS. 14 and 15) can be made in many different ways. In the non-limiting example shown, the bag B is formed from a single flexible plastic sheet folded upon itself, and includes first and second opposing body panels 25 and 26. Body panels 25 and 26 are fixedly connected to each other along a pair of sides 28 and 30 and a bottom 32 which extends between the pair of sides 28 and 30. Bag B preferably has the zipper closure 36 extending along a mouth 38 formed opposite the bottom 32 of bag B, in which the zipper closure 36 has complementary profiles for interlocking and unlocking. In one example, the complementary profiles include a male track 18 and a female track 19. An interior volume 39 of the bag B is accessible through the mouth 38, when the zipper closure 36 is unlocked in an open position.

The opposite ends of the zipper closure 36 are provided with ultrasonically welded ends of the male and female profile forming raised sections 24 and 27. These raised portions 24, 27 form end stops to prevent the slider from being easily pulled off of the ends of the zipper closure. Many variations are possible. For example, end stops can be made according to any of U.S. Pat. Nos. 7,921,534; 5,088,971; 5,131,121; 5,161,286; and 5,448,807, each of which is incorporated herein by reference in its entirety.

As shown in FIG. 15, in this non-limiting example, tracks 18 and 19 have interlocking male and female profiles 14 and 15 extending the length thereof in the form of rib and groove elements on the respective tracks. The tracks 18 and 19 may be extruded separately with a fin 16 and attached to the respective sides of the bag mouth 38, or may be extruded integrally with the sides of the bag mouth 38. If the tracks 12 and 13 are extruded separately, they are attachable by of respective first and second fin 16, incorporated within the tracks, that is heat sealed to the bag. The male and female profiles 18 and 19 have complementary cross-sectional shapes and are closed by pressing a bottom of the elements together first and then rolling the elements to a closed position toward the top thereof. The cross-sectional shapes of the interlocking male and female profiles 14 and 15 are described in U.S. Pat. No. 5,007,143, which is incorporated herein by reference. There can be many different embodiments, and this is just an example for illustrative purposes.

Figure 1:
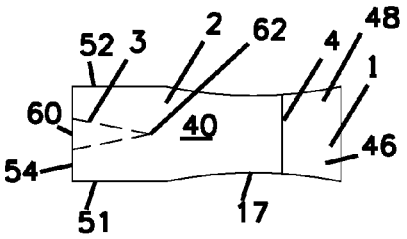
FIG. 1 is a plan view of a slider, constructed in accordance with principles of this disclosure.
Figure 2:
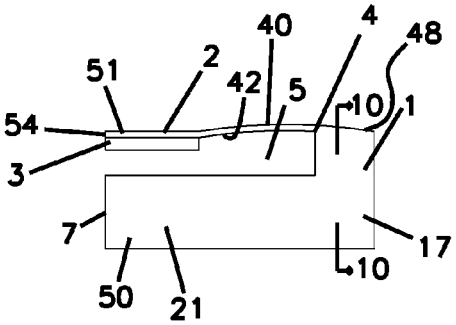
FIG. 2 is a front elevational view of the slider of FIG. 1.
Figure 3:
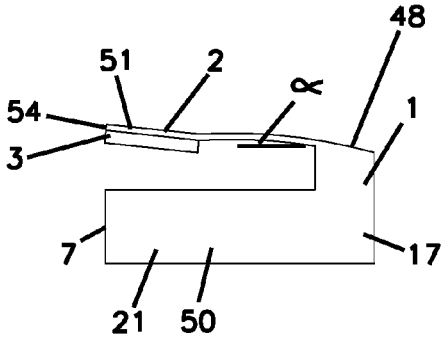
FIG. 3 is the view of the slider of FIG. 2 and showing the tab extending in an upward position from the base.

In reference now to FIGS. 1-3, an example embodiment of slider 1 incorporating child resistant features is described. The slider 1 is slidably located on the zipper closure 36. The slider 1 includes a flexible tab 2. The flexible tab 2 has an upper surface 40, a bottom surface 42 (FIG. 2), and first and second sides 51, 52 extending between the upper surface 40 and bottom surface 42. The tab 2 includes a torpedo 3 extending from the bottom surface 42. The term "torpedo" refers to an opening finger or plow for causing separation of interlocked profiles 14, 15, in the form of a projection from the bottom surface 42. In some example embodiments, the torpedo 3 does not physically penetrate the interlocked profiles 14, 15, but does extend between the tracks 18, 19, which causes the tracks 18, 19 to separate from each other resulting in the tracks 18, 19 to unroll and separate the interlocked profiles 14, 15. The depth of the torpedo 3 can be varied to make it easier or more difficult to open closure 36. As can be seen in FIG. 1, the torpedo 3 is triangle shaped along a horizontal plane. When the slider 1 is moved into a notch 8 in the zipper closure, the tab 2 can be selectively moved into a position to insert the torpedo between the male and female tracks 18, 19 and result in separation of the interlocked profiles 14, 15 as the slider 1 is moved in an opening direction 44 (FIG. 14) along the zipper closure 36.

Many embodiments of slider 1 are possible. The slider 1 straddles the zipper closure 36 at the top of the bag B and is adapted for opening or closing the interlocking tracks 12 and 13 of the zipper closure 36. The slider 1 may be molded from any suitable plastics such as, for example, nylon, polypropylene, polyethylene, polystyrene, Delrin, or ABS. In one embodiment the slider is molded as a single piece. Other embodiments are possible.

Figure 10:
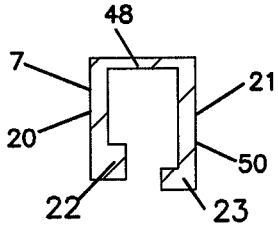
FIG. 10 is a cross-sectional view of the slider of FIG. 1, the cross-section being taken along the line 10-10 of FIG. 2.

In the example embodiments, as shown in FIG. 10, the slider 1 comprises an inverted U-shaped member including a transverse support member or body 17 from which tab 2 extends outward.

In the illustrated examples, the slider body 17 includes a base 46. The base 46 includes a top member 48, and a bottom member 50, and side wall 7. The bottom member 50 can include first and second spaced, opposing legs 20, 21, each having an inwardly extending shoulder structure 20, 21. The first and second legs 20, 21 have internal surfaces that are spaced sufficiently close together to press the male and female profiles 14, 15 into interlocking relationship as the slider 1 is moved in a closing direction 56 along the zipper closure 36.

The base 46 is adapted to move along top edges of the male and female tracks 18, 19 with the first and second legs 20, 21 straddling the tracks 18, 19. Shoulder structures 22, 23 engage a bottom of the zipper closure 36 to prevent the slider 1 from being lifted off the edges of the tracks 18, 19, while the slider 1 straddles the zipper closure 34.

Figure 11:
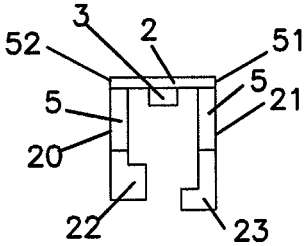
FIG. 11 is an end view of the slider of FIG. 1.

FIG. 10 shows a cross sectional view of the slider taken at a cross section 10-10 of the slider 1 shown in FIG. 2, and FIG. 11 shows an end view of the slider 1.

Figure 4:
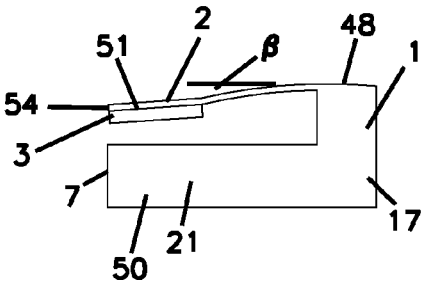
FIG. 4 is the view of the slider of FIG. 2 and showing the tab extending in a downward position from the base.
Figure 5:
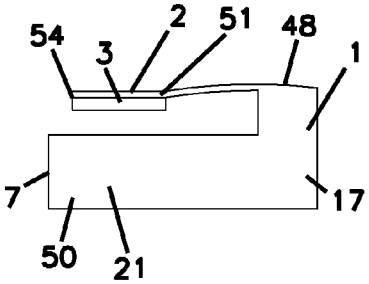
FIG. 5 is a front elevational view of an alternate embodiment of the slider of FIG. 1.
Figure 6:
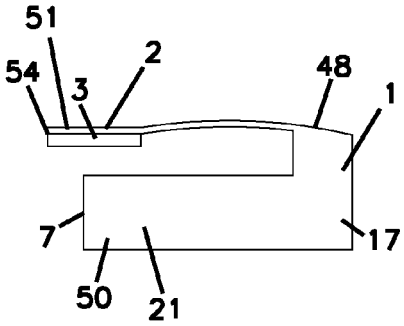
FIG. 6 is a front elevational view of the another alternate embodiment of the slider of FIG. 1.

The flexible tab 2 can extend from the top member 48 of the base 46 to a position before end wall 7 as shown in FIG. 5; to a position that is even with wall 7 as shown in FIG. 2; or to a position that is beyond end wall 7 as shown in FIG. 6. Flexible tab 2 can extend outward in a level direction as shown in FIG. 2; an upward direction at an angle a above the horizontal as shown in FIG. 3; or a downward direction at an angle β below the horizontal as shown in FIG. 4. As can be seen in FIG. 2, the flexible tab 2 is cantilevered from the top member 48. The tab 2 is spaced above the first and second legs 20, 21, such that there is a cavity 5 of open volume in between. The cavity 5 is leg-free, sidewall-free, and free of other slider structure, so that the open volume of the cavity 5 extends from the end wall 7 between the tab 2 and legs 20,21. There can be many variations, and the example embodiments shown in FIGS. 2-6, the cavity 5 extends at least 50%, for example at least 60% and not greater than 90% of an overall length of the slider 1 from the end wall 7.

Figure 9:
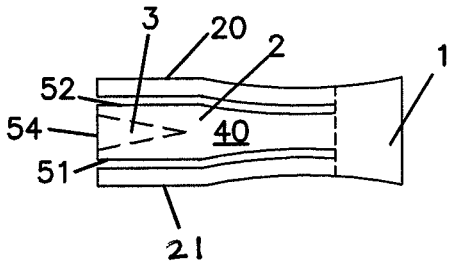
FIG. 9 is a plan view of the another alternate embodiment of the slider of FIG. 1.
Figure 12:
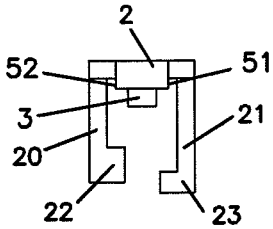
FIG. 12 is an end view of the slider of FIG. 9.

The tab 2 is joined to the top member 48 of the base 46 at a pivot point or pivot axis 4. The tab 2 is constructed and arranged to flex relative to the base 46 about the pivot axis 4 in a direction toward and away from the first and second legs 20, 21. In one embodiment, the tab 2 can flex toward the legs 20, 21 by moving into the volume defined by cavity 5. In another embodiment as shown in FIGS. 9 and 12, the tab 2 can flex toward the legs 20, 21 and fit in between the legs 20, 21 in its most downward position. When the tab 2 is flexed toward the bottom member 50, it can then flex back to its resting position by flexing away from the bottom member 50 back through the cavity 5 to its original and static position.

The torpedo 3, as mentioned previously, extends from the bottom surface 42 of the tab 2. The torpedo 3 flexes toward and away from the bottom member 50 and the first and second legs 20, 21 with the flexing of the tab 2. As can be seen in FIGS. 1 and 2, in this embodiment, the torpedo 3 is located at an end 54 of the tab 2. In this example, the torpedo 3 is triangle shaped, with the triangle base 60 being at or adjacent with the end 54 of the tab 2. In other embodiments, the torpedo 3 can be spaced from the end 54. An apex 62 of the torpedo 3 is opposite of the triangle base 60, and is useful in initially penetrating and separating the male and female tracks 18, 19 and result in separation of the interlocked male and female profiles 14, 15, when operably positioned to do so.

The torpedo 3 is selectively movable into a position to be between the male and female tracks 18, 19 and result in separation of the interlocked male and female profiles 14, 15 as the slider 1 is moved in opening direction 44 along the zipper closure 36.

Figure 7:
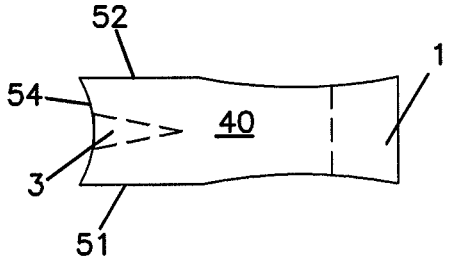
FIG. 7 is a plan view of another alternate embodiment of the slider of FIG. 1.
Figure 8:
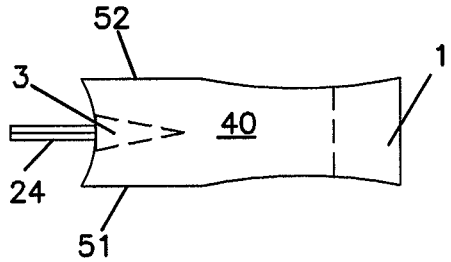
FIG. 8 is a schematic plan view of the slider of FIG. 7 at an end of the zipper closure adjacent to an ultrasonically welded end.

In the variation shown in FIG. 7, the end 54 of the tab 2 is concave. In the schematic view of FIG. 8, the concave end 54 engages the raised portion 24 of the ultrasonically welded end of the zipper closure 36 to improve the end retention of the slider 1.

It should be understood that the tab 2 can move down about pivot axis 4 by application of downward pressure, and will spring back to its original position when released. The thickness, length, and pivot axis of the tab 2 can be adjusted to provide challenge to a young child while making it feasible for adults and senior citizens to operate the slider 1 and open the bag B. International and national child resistant packaging testing protocols consider a child to be young if the child is under the age of fifty-two months.

In reference now to FIG. 13, the slider 1 is shown parked at a distance 10 from a side 28 of the bag B. In this position, the zipper closure 36 is closed, with the male and female profiles 14, 15 interlocked. The zipper profile 6 includes notch 8 spaced a distance 11 from the side 28 of the bag B. The distance 11 will be such that the slider 1 must be moved from its parked position to find the notch 8. For example, this can be about one-fourth down the length of the zipper closure 36. The length 12 of the notch 8 can be slightly larger than that of a length of the torpedo 3 to allow easy insertion into the notch 8. It will be desirable to have the notch 8 to be as short as possible to increase the challenge of engaging the torpedo 3 in the zipper closure 36. In some implementations, the length 12 of the notch 8 can be about equal to the length of the torpedo 3, while in some implementations, the length 12 of the notch 8 can be less than the length of the torpedo 3. There can be many variations.

In operation, to open the zipper closure 36, as a first step, the slider 1 is grasped by the user. For example, the slider 1 can be grasped with a thumb on one side of the slider 1 and a middle finger on the opposite side, while downward pressure is applied on the tab 2 with index finger. As a second step, the slider 1 is moved from the parking place on the zipper closure 36 toward the opposite end of the zipper closure 36 while maintaining downward pressure on the tab 2 until finding the notch 8 that will permit the tab 2 to flex downwardly into cavity 5. As a third step, adult level force on the slider 1 is used to engage the torpedo 3 between the male and female tracks 18, 19 and result in separation of the interlocked male and female profiles 14, 15. As a fourth step, a continuous downward pressure is applied on the tab 2 while slider 1 is moved in the opening direction 44.

Upon release of the downward pressure of the tab 2, the tab 2 will return to its original level position and disengage from the zipper profile 2. The user will then open the bag B to access the interior volume 39 and package contents 64. The bag B may then be reclosed by sliding the slider 1 to its original position. It is not necessary or desirable to push down on the tab 2 to close the zipper closure 36, as the tab 2 needs to remain in its original disengaged state during the closing of the zipper closure 36.

It should be appreciated that the slider 1 has advantages. For example, the shape of the slider 1 in the level tab embodiment is suitable for stacking in automated feeding magazines for high volume production.

Furthermore, the slider 1 and zipper closure 36 present a quadruple challenge to a user who tries to move the slider 1 to open the closure 36. The slider 1, including the unframed horizontal flexible tab 2 extends along the top of the slider 1. The slider 1 is parked at one end of the bag, when the zipper closure 36 is in a closed position. To open the bag B, the user will utilize one hand to hold the bag B at one end, and the other hand to actuate the slider 1. Actuation of the slider 1 is accomplished by at the least the four operations discussed above.

From review of the FIGS. herein and the above descriptions, it should be apparent that the zipper closure 36 permits initiation to open the mouth 38 at only one location along the length of the closure 36—at the notch 8. This helps to inhibit easy opening of the closure 36 by a child. The separation of the interlocking profiles 14, 15 is initiated at a side of the profiles 14, 15 through the notch 8. This system has advantages over other systems that might have a small opening along a top of the profiles to permit mechanical separation from above, but which could also allow a child to introduce teeth or fingernails into the zipper closure and open it.

The above description represents example principles of this disclosure. Many embodiments can be made applying these principles.

What is claimed is:

1. A slider for a zipper closure having a male track and a female track with complementary profiles for interlocking and unlocking; the slider comprising:

(a) a base having a top member and a bottom member; the bottom member including first and second legs each terminating in an end wall;

(i) the base adapted to move along top edges of the tracks with the first and second legs straddling the tracks;

(b) a tab extending from the top member of the base and being spaced above the first and second legs of the base such that there is a cavity of open volume in between, the cavity being leg-free, sidewall-free, and free of other slider structure so that the open volume of the cavity extends from the end wall between the tab and the first and second legs; the tab being constructed and arranged to flex relative to the base about a pivot axis in a direction toward and away from the first and second legs;

(c) a torpedo extending from a bottom surface of the tab and moving toward and away from the first and second legs with flexing of the tab; the torpedo being selectively moveable into a position to be between the male track and female track and result in separation of the interlocking profiles as the slider is moved in an opening direction along the zipper closure; and (d) the first and second legs having internal surfaces spaced sufficiently close together to press the profiles into interlocking relationship as the slider is moved in a closing direction along the zipper closure.

2. A slider according to claim 1 wherein:

(a) the torpedo is triangle-shaped.

3. A slider according to claim 1 wherein:

(a) the tab has an end that is even with an end of the slider.

4. A slider according to claim 1 wherein:

(a) the tab has an end extending beyond an end of the slider.

5. A slider according to claim 1 wherein:

(a) the tab has an end that does not extend as far as an end of the slider.

6. A slider according to claim 1 wherein:

(a) the tab extends in a horizontal direction relative to the base.

7. A slider according to claim 1 wherein:

(a) the tab extends in an upward direction from the base.

8. A slider according to claim 1 wherein:

(a) the tab extends in a downward direction from the base.

9. A slider according to claim 1 wherein:

(a) the tab ends in a concave shape.

10. A slider according to claim 1 wherein:

(a) the tab is movable between the first and second legs of the slider.

11. A slider according to claim 1 wherein the slider is molded as a single piece.

12. A slider for a zipper closure having a male track and a female track with complementary profiles for interlocking and unlocking; the slider comprising:

(a) a base having a top member and a bottom member; the bottom member including first and second legs;

(i) the base adapted to move along top edges of the tracks with the first and second legs straddling the tracks;

(b) a tab extending from the top member of the base and being spaced above the first and second legs of the base; the tab being constructed and arranged to flex relative to the base about a pivot axis in a direction toward and away from the first and second legs, and the tab extending in a downward direction from the base;

(c) a torpedo extending from a bottom surface of the tab and moving toward and away from the first and second legs with flexing of the tab; the torpedo being selectively moveable into a position to be between the male track and female track and result in separation of the interlocking profiles as the slider is moved in an opening direction along the zipper closure; and (d) the first and second legs having internal surfaces spaced sufficiently close together to press the profiles into interlocking relationship as the slider is moved in a closing direction along the zipper closure.

13. A slider according to claim 12 wherein:

(a) the torpedo is triangle-shaped.

14. A slider according to claim 12 wherein:

(a) the tab has an end that is even with an end of the slider.

15. A slider according to claim 12 wherein:

(a) the tab has an end extending beyond an end of the slider.

16. A slider according to claim 12 wherein:

(a) the tab has an end that does not extend as far as an end of the slider.

17. A slider according to claim 12 wherein:

(a) the tab ends in a concave shape.

18. A slider according to claim 12 wherein:

(a) the tab is movable between the first and second legs of the slider.

19. A slider according to claim 12 wherein the slider is molded as a single piece.

* * * * *